United States Patent [19]

Karsan et al.

[11] Patent Number: 4,781,497

[45] Date of Patent: Nov. 1, 1988

[54] TENSION-RESTRAINED ARTICULATED PLATFORM TOWER

[75] Inventors: Demir I. Karsan; Shaddy Y. Hanna; Jimmy Y. Yeung, all of Ponca City, Okla.

[73] Assignee: Conoco Inc., Ponka City, Okla.

[21] Appl. No.: 9,976

[22] Filed: Feb. 2, 1987

[51] Int. Cl.[4] ..... E02B 17/02

[52] U.S. Cl. ..... 405/202; 405/204; 405/210; 405/224

[58] Field of Search ..... 405/195, 204, 202, 224, 405/210, 227

[56] References Cited

U.S. PATENT DOCUMENTS

| | | | |
|---|---|---|---|
| Re. 32,119 | 4/1986 | Abbott et al. | 405/227 |
| 4,094,161 | 6/1978 | Moinard et al. | 61/95 |
| 4,169,424 | 10/1979 | Newby et al. | 114/265 |
| 4,280,238 | 7/1981 | van Heijst | 9/8 |
| 4,378,179 | 3/1983 | Hasle | 405/227 |
| 4,432,668 | 2/1984 | Rank | 405/202 |
| 4,439,055 | 3/1984 | Quigg et al. | 405/202 X |
| 4,599,014 | 7/1986 | McGillivray et al. | 405/225 |
| 4,610,569 | 9/1986 | Finn et al. | 405/202 |
| 4,648,750 | 3/1987 | Horton | 405/208 |
| 4,684,292 | 8/1987 | Danguy Des Deserts | 405/202 |
| 4,696,603 | 9/1987 | Danaczko et al. | 405/227 |
| 4,696,604 | 9/1987 | Finn et al. | 405/227 |

FOREIGN PATENT DOCUMENTS

| | | |
|---|---|---|
| 56-103596 | 1/1983 | Japan . |
| 2123883A | 1/1984 | United Kingdom . |
| 2162883A | 2/1986 | United Kingdom . |

OTHER PUBLICATIONS

Buslov, Dr. V. M., & Dr. D. I. Karsan, "Deepwater Platform Designs: An Illustrated Review (part 1)", *Ocean Industry*, Oct. 1985, pp. 47–52.

Buslov, Dr. V. M., & Dr. D. I. Karsan, "Deepwater Platform Designs: An Illustrated Review (part 2)", *Ocean Industry*, Dec. 1985, pp. 51–55.

Buslov, Dr. V. M., & Dr. D. I. Karsan, "Deepwater Platform Designs: An Illustrated Review (part 3)", *Ocean Industry*, Feb. 1986, pp. 53–62.

Andrier, B. L., Y. Delepine, & J. Gauvrit, "ROSEAU: A Deepwater Compliant Platform", *Proceedings of the 18th Annual Offshore Technology Conference*; May 5–8, 1986, pp. 299–308.

*Primary Examiner*—David H. Corbin

*Attorney, Agent, or Firm*—Richard K. Thomson

[57] ABSTRACT

A tension-restricted articulated platform tower for offshore oil and gas production. Two or more tower segments of increasing lateral dimension (proceeding toward the ocean floor) are stacked and articulated by means of a resilient joint. The platform tower behaves as a fixed tower under normal quiescent conditions with each of the segments above the base segment sitting thereabove in an at rest position. When forces sufficient to unseat the compressed resilient joint element are directed against the platform tower (e.g., from wind, waves, or water current), the tower behaves complaintly with tension elements secured to each corner post providing a restorative force proportional to the amount of tower movement.

19 Claims, 4 Drawing Sheets

TENSION-RESTRAINED ARTICULATED PLATFORM TOWER

FIELD OF INVENTION

The present invention is directed to a tower for an offshore platform used to produce hydrocarbons from underground resources. More particularly, the present invention is a tension-restrained articulated platform that affords a cost effective alternative to existing deep water (2000–4000 feet) platform towers.

BACKGROUND AND SUMMARY OF THE INVENTION

As the search for offshore oil and gas reservoirs has moved into deeper waters, developers have been forced to search for more cost effective alternatives than the conventional fixed platforms. Beyond about 1200–1600 feet of water, the structural steel necessary for a conventional platform tower makes development uneconomic for all but the largest of reservoirs. The recent drop in oil prices has exacerbated the problem and extended the payback on even these large reservoirs to the point the developers have second thoughts about proceeding with a development project. A less expensive platform support is required.

One of the limiting factors for a fixed platform tower is providing sufficient structural steel to make the tower rigid enough to avoid the problem of resonance. During storms, the waves having the highest energies occur in the five to twenty second frequency interval. In order to avoid the possibility of a cataclysmic failure resulting from harmonic motion of the tower, it is important that the tower be designed to have each of its natural periods fall outside this 5–20 second interval. For a fixed platform, this requires the addition of significant amounts of steel to reinforce the tower to increase its rigidity. Even then, the first natural period will still normally fall in above the 5 second region, putting the structure at risk.

A more recent design alternative has been to make the tower compliant, i.e., to permit the tower to move responsive to the force of the waves and then to return to its initial, or at rest, position. This alternative permits the tower to be designed to have a fundamental (first) natural flexural period that exceeds 20 seconds, reducing the hazard of resonance. Since the platform tower can be less rigid, the structural steel required can be reduced, producing a potential cost savings. However, the compliant designs proposed to date each have a feature that offsets the potential savings, e.g., guy wire systems, buoyancy tanks, a system of elongated load-bearing piles, a complex pivot arrangement, etc.

The present invention is directed to a cost-effective alternative enabling hydrocarbon production in water depths in excess of 2000 feet (610 m) up to depths of 4000 feet (1220 m) and, possibly, even greater. The tower is comprised of at least two stacked, articulated sections that behave as a fixed platform in quiescent conditions, i.e., the weight of the upper sections is transmitted through structural supports in the lower and base sections to the ocean floor. The base section can be a gravity base or a steel base that is piled to the ocean floor. In the event of a storm with high energy wave and wind forces, the tower behaves as a compliant tower, moving with those forces and being restored to its rest position by a plurality of tension elements that are increasingly tensioned by the compliant motion; the greater the movement, the larger the restorative force.

The tower is designed such that all of its natural periods are outside the critical 5–20 second interval. The tower sections are each interconnected by a resilient joint means and, if there are more than two tower sections, each of the subsequent sections is directly interconnected to the base or to one of the other lower sections (depending on flexibility requirements) by its own set of restoring tension elements.

Various other characteristics, features and advantages of the present invention will become apparent after a reading of the following detailed description.

DETAILED DESCRIPTION OF THE PREFERRED EMBODIMENTS

Figure 1:
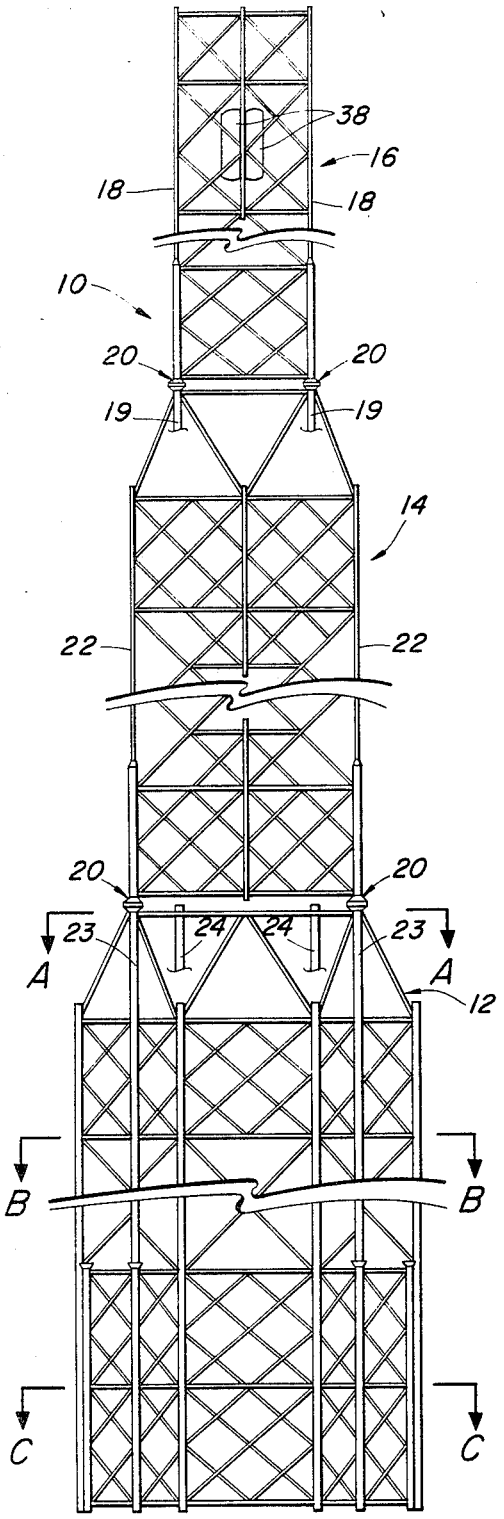
FIG. 1 is a side view of an embodiment of the tension-restrained articulated platform tower of the present invention having three tower segments.

A first embodiment of the tension-restrained articulated platform tower of the present invention is depicted in FIG. 1 generally at 10. As shown there, tower 10 is comprised of three segments: a base segment 12, a first additional segment 14 and a second additional segment 16. Segment 16 has four tubular corner posts 18 which, by way of example and not limitation, may be comprised of 54" OD steel tubulars with a 1½" wall thickness. Segment 14 has four tubular corner posts 22 which, again, by way of example, may be 72" OD steel tubulars with a 2" wall thickness. Segments 14 and 16 are articulatedly mounted atop segments 12 and 14, respectively, by resilient joints 20, there being one such joint 20 at the lowermost end of each tubular corner post 18 and 22. The key element of resilient joint 20 is an annular elastomeric element 21 comprised of laminations of a high durometer elastomer and steel reinforcing plates. A plurality of support fins 17 transfer the load from corner post 18, 22 to element 22.

Figure 3A:
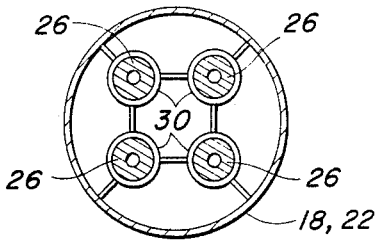
FIG. 3A is a partial cross-sectional top view as seen along line 3—3 in FIG. 1.
Figure 3B:
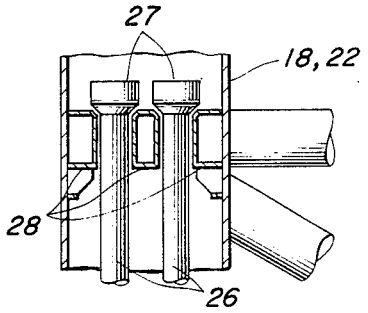
FIG. 3B is a cross-sectional side view of an upper corner support column of the first embodiment of the present invention.
Figure 3C:
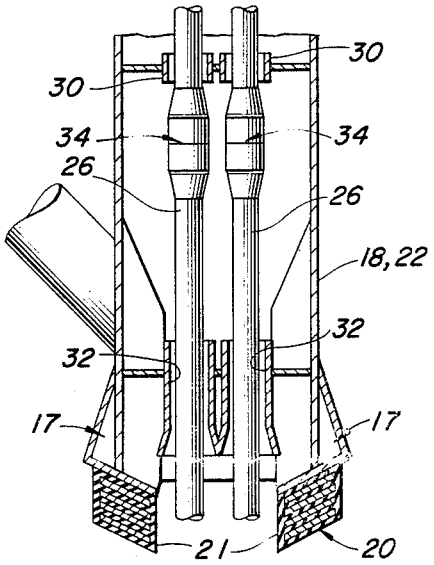
FIG. 3C is a cross-sectional side view of a mid-section support column of the first embodiment of the present invention.

Segment 14 has a flanged vertical support 19 that mates with each corner post 18 of segment 16. Likewise, segment 12 has a flanged vertical support 23 that mates with each corner post 22 of segment 14. Segment 12 also has a plurality of vertical tubular members 24 (FIGS. 2A–2C) that form continuations of vertical supports 19 of segment 14. Vertical supports 19 and tubular members 24 have been broken away in FIG. 1 to avoid undue complexity. As best seen in FIGS. 3A–3C, each corner post 18 and 22 and vertical support 19 and 23, respectively, house a plurality of tension elements 26 (shown here as four in each corner post, although they may be fewer or greater in number). Each tension element 26 in vertical supports 19 extends through vertical tubular members 24 of base segment 12 and is anchored near the bottom of that segment by means described in greater detail hereafter. Tension elements 26, by way of example, may be comprised of HY-80 steel tendons having a 9⅝" OD and a 3" ID, although other materials, such as composites may also be employed. Horizontal cross supports and angulated reinforcing beams are provided in segments 12,14 and 16 to provide the rigidity desired.

As seen in FIG. 3B, tension elements 26 are each formed with a top flange 27 by which the elements 26 hang on support beams 28. Internal support guides 30 and 32 have sufficient internal diameters to permit the connecting joints 34 of tension elements 26 to readily pass therethrough.

Figure 2A:
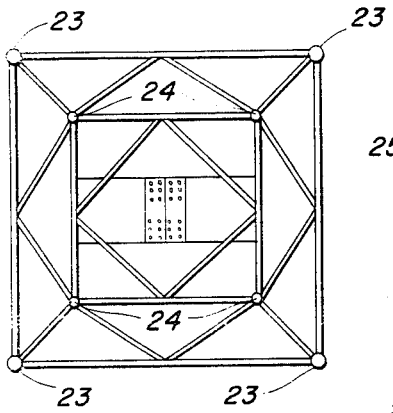
FIG. 2A is an instantaneous cross-sectional view of the three section tower embodiment of the present invention as seen along line A—A of FIG. 1.
Figure 2B:
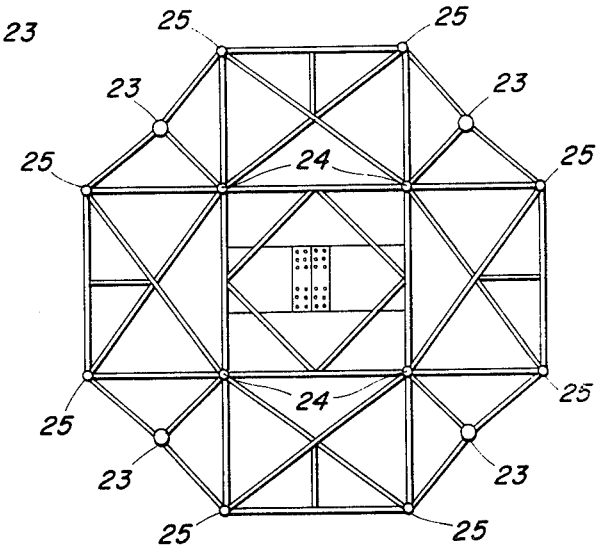
FIG. 2B is an instantaneous cross-sectional top view as seen along line B—B of FIG. 1.
Figure 2C:
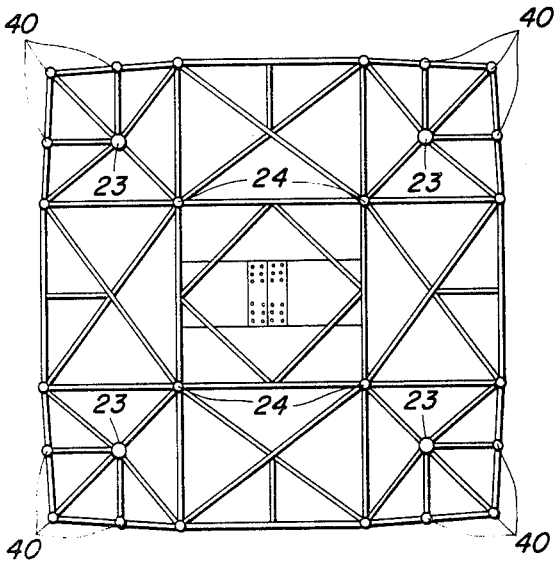
FIG. 2C is a cross-sectional top view as seen along line C—C of FIG. 1.
Figure 7:
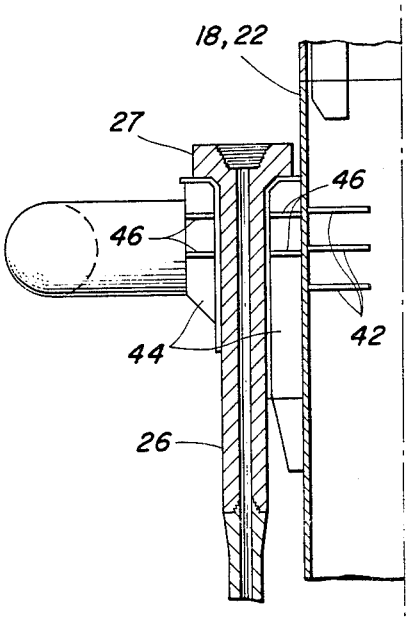
FIG. 7 is a detailed cross-sectional side view of an external support for the tension element of this second embodiment.

Examining FIGS. 2A–2C in conjunction with FIG. 1, it will be appreciated that FIG. 2A shows not only the cross section of the top of base segment 12, but the cross sections of the lower portion of segment 14 (outer square), and upper portion of segment 14 and the cross section of segment 16 (inner square, corners at 23). The transitional cross section of base segment 12 shown in FIG. 2B is maintained throughout the majority of its length in order to provide unobstructed access to the pile guides 40 (three on each corner).

The embodiment depicted in FIGS. 1–3 is designed for 3000 feet (915 m) of water. Although the following dimensional details were optimized through the use of a mathematical model, they are, again offered as an example of the present invention, not as a limitation thereof. The base section is 300 feet (91.4 m) square. In order to keep the weight of this section managable, it is preferred its length not exceed 800 feet (244 m) and more preferably not exceed 600 feet (183 m). It is preferred that the lengths of segments 14 and 16, L1 and L2, respectively, not exceed about 1250 feet (381 m) to maintain segment rigidity. The ratio of L2 to L1 should preferably be maintained within the limits of 0.8 to 1.2 and more preferably about 1.0 Segment 14 is 200 feet (61 m) square and 1200 feet (366 m) long and segment 16 is 120 feet (37 m) square and 1250 feet long. The tower therefore protrudes some 50 feet (15 m) above the surface to receive the platform.

Segment 16 (and, if necessary, segment 14) is provided with a virtual mass generator depicted in FIG. 1 as storage tanks 38. The purpose of the virtual mass generator is to "capture" water and make the upper tower segments behave as if they had the additional mass of the water displaced during swaying motion. This added virtual mass will make the tower resist motion and will increase some of the natural periods of the tower to insure that these periods exceed the 20 seconds upper limit on the critical interval (5–20 seconds) in which the waves have their highest energy levels and are therefore most threatening of damage due to resonance. Obviously, a system of baffles would suffice for this purpose, but storage tanks 38 could also be utilized to provide a second purpose of storing fluids either produced oil or liquid natural gas or injection fluids.

The base section 12 is piled to the ocean floor with twelve 500 foot (152 m) long piles through pile guides 40 which are preferably 100 feet (30.5 m) in length. The base section will therefore behave as a rigid member. In calm water, normal currents, tension-restrained articulated platform 10 will behave as a fixed platform, loads being transferred from the corner posts 18 of segment 16 downwardly and outwardly by horizontal and angulated braces of segment 14 to corner posts 22 and, in turn, to the outermost vertical posts 25 of base segment 12. In stormy seas, the articulated platform will by virtue of resilient joints 20 behave compliantly, the virtual mass generator 38 lengthening the period of motion to avoid potential hazards associated with harmonic motion (i.e., resonance). As the compression on joints 20 is reduced, the corresponding tension elements 26 will stretch proportionately to the distance moved, the greater the motion, the greater the restoring force created. It will be seen, that unlike some compliant systems, the tension elements of the tension-restrained articulated platform are not subject to constant cyclic loading causing fatigue that shortens wear life. Tension elements 26 will be subjected to only a few dozen (or less) tensionings during any given storm.

Although depicted in three segments for utilization in 3000 foot deep water, it will be appreciated that the principles are equally applicable to a two segment system that could be used in the 2000–2400 foot range or to a four or more segment tower useful in even deeper water. If four or more segments are used, it will be appreciated that depending on the flexibility requirements of the tower, it may be preferable to have the tension elements of the topmost segments tied off to one of the other lower sections rather than to the base section per se.

Figure 5:
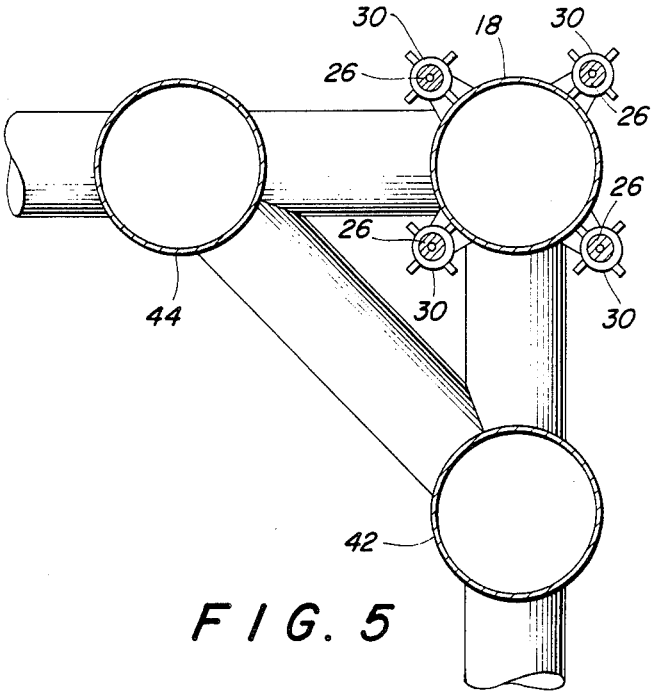
FIG. 5 is a cross-sectional top view of this second embodiment as seen along line 5—5 of FIG. 4.
Figure 4:
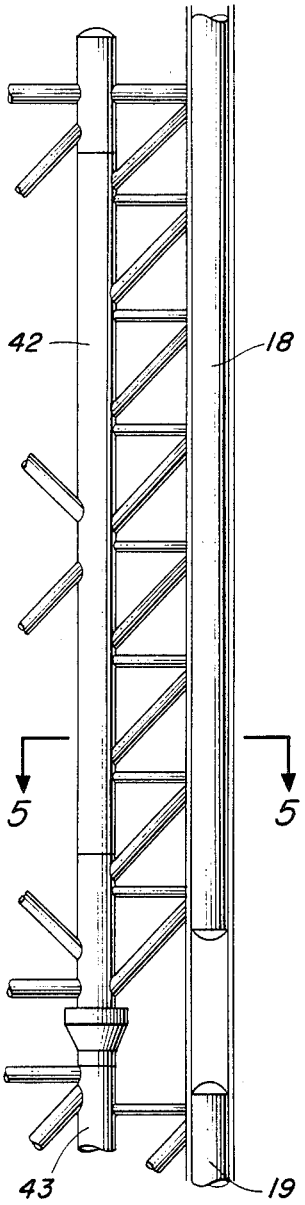
FIG. 4 is a side view of a portion of a second embodiment of the present invention.

A second embodiment of the present invention is depicted in FIGS. 4–7. The resilient element 21 of joint 20 is both a most crucial element in the system and the most likely to suffer a structural failure. It is therefore preferred that redundant resilient joints be provided at each corner of tower 10. As best seen in FIGS. 4 and 5, single corner post 18 (or 22) gives way to a dual corner post (42 and 44) configuration within about 100 feet (30.4 m) of the joint 20. The lower section (12 or 14) has a mirror construction for a similar 100 feet to mate with posts 42 and 44 (only post 43 being shown), and then returns to a single tubular support (19 or 23).

Additionally, shown in this embodiment is a means of externally mounting tension elements 26. While there are some benefits to mounting tension elements 26 within the vertical supports of the tower structure (e.g., protection from the elements), the disadvantages (monitoring structural integrity, difficulty of change out of damaged element) outweigh the advantages. It is therefore, preferred that an external mounting be employed. Obviously, external mounting can be used with either a single or double corner post configuration. Guide members 30 can be mounted externally of corner posts 18 and 22 (and mating supports 19 and 23) as seen in FIG. 5. An externally mounted support 28 receives the flange 27 of tension element 26. Ring stiffeners 42 are positioned internally of corner posts 18 and 22 to avoid buckling and vertical fins 44 and lateral fins 46 are provided to inhibit torsionally induced sagging and twisting.

Figure 6:
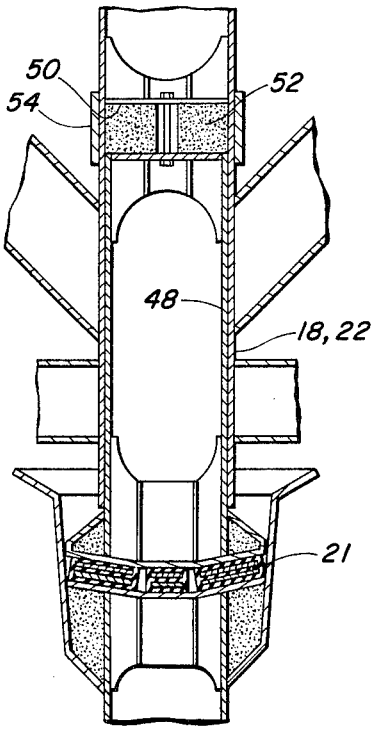
FIG. 6 is a cross-sectional side view of one of the resilient joints of this second embodiment.

FIG. 6 depicts resilient joint 20 for the externally mounted tension element embodiment. Resilient element 21 is a laminated hard elastomeric material laminated with metallic reinforcing plates like the first embodiment; however, with the tension element clearance hole removed, larger surface area can be achieved with a smaller diameter corner post. A leveling feature is provided by pipe section 48 which slides within the end of corner post 18. The volume 50 is adjustable to allow adjustment for variations in length of corner posts 18,22 resulting from dimensional tolerances. Once each leg has been adjusted to level segments 14 and 16, the volume 50 can be filled with grout or a similar material 52 to fix each adjustable section 48 in the desired position. Alternatively, the material 52 may already be in volume 50 and a limited amount permitted to escape to level the platform tower segments. A sleeve 54 can be used to seal off the fill hole (not shown).

Figure 8A:
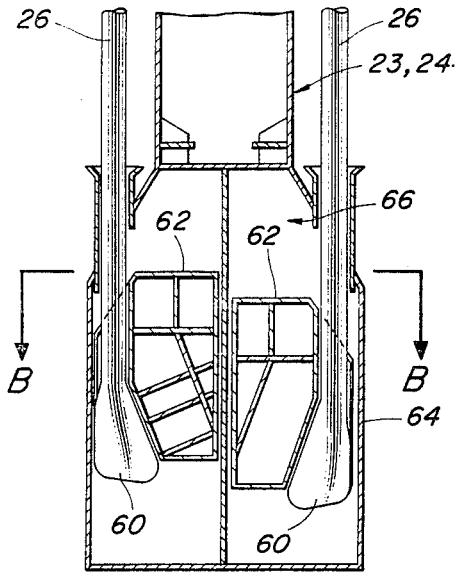
FIG. 8A is a schematic side view with portions broken away to review greater detail of a first embodiment of a tension element footing.
Figure 8B:
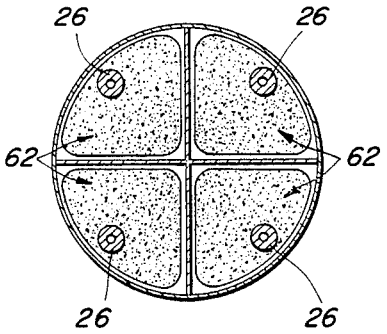
FIG. 8B is a cross-sectional top view of the footing as seen along line B—B of FIG. 8A.

The bottom anchor or footings for the externally mounted tension elements is shown in FIGS. 8A and 8B. The base of each tension element is formed with a wedge like portion 60. A boot member 62 is hung upon each wedge 60 within housing 64. Once the sections of the tension elements 26 from the segments have all been treadingly interconnected and are hanging by upper flanges 27, the spaces 66 are filled with grout to eliminate the possibility of upward movement of boot members 62. Tension elements 26 are only slightly pretensioned by an amount equal to the weight of each element 26 in water.

Figure 9A:
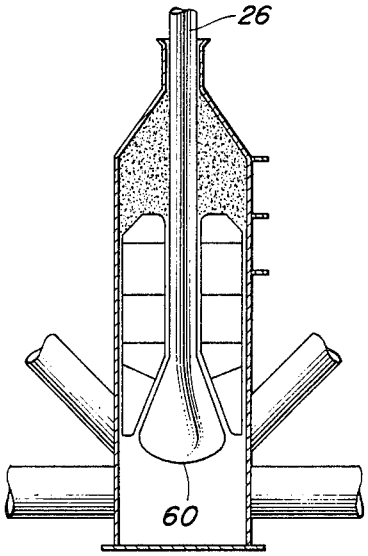
FIG. 9A is a cross-sectional side view of a second embodiment of a tension element footing as seen along line A—A in FIG. 9B.
Figure 9B:
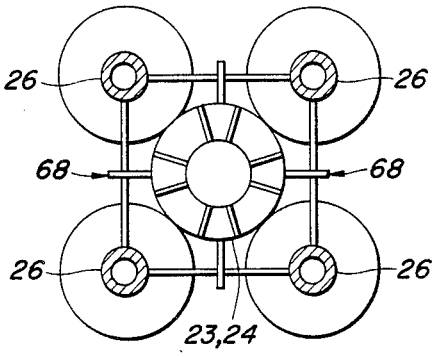
FIG. 9B is a top view of the second embodiment of the footing system.

An alternative configuration is shown in FIGS. 9A and 9B. Instead of a single housing 64 being attached to the base of supports 24 (or 23), individual housing 64 may be positioned around supports 23 and 24 and secured thereto and to one another by frame elements 68.

Various changes, alternatives and modifications will become apparent to persons of ordinary skill in the art following a reading of the foregoing specification. It is intended that all such changes alternatives and modifications as fall within the scope of the appended claims, be considered part of the present invention.

We claim:

1. A tension-restrained articulated platform tower for supporting a deep water offshore drilling and production platform, said tower having a plurality of corners and comprising:

(a) a base tower section having horizontal and vertical structural members with angulated reinforcing elements;

(b) means for securing said base tower section to a particular portion of an ocean floor targeted for production of hydrocarbon fluids;

(c) at least one additional tower section;

(d) means for mounting said at least one additional tower section atop said base tower section in such a manner that each of said plurality of corners is pivotally articulated to permit compliant motion of said at least one additional tower section in response to wind, current and wave forces from a first at rest position, vertical loads from said at least one additional section being transmitted to the ocean floor through said vertical structural members of said base tower section when said at least one additional tower section is in said at rest position;

(e) a plurality of tension elements interconnected between said at least one additional tower section and said base tower section, said tension elements extending across said articulated mounting means and providing the primary position restoring force for said at least one additional tower section to return it to said at rest position following compliant motion induced by said wind, current and wave forces.

2. The tension-restrained articulated platform tower of claim 1 wherein each of said plurality of tension elements is nominally prestressed by an amount at least equal to its weight in water.

3. The tension-restrained articulated platform tower of claim 1 wherein each of said plurality of tension elements extends from a point in proximity to the bottom of said base tower section to a point in proximity to the top of said at least one additional tower section.

4. The tension-restrained articulated platform tower of claim 1 wherein said at least one additional tower section comprises at least two additional tower sections, a first additional tower section positioned atop the base tower section and a second additional tower section positioned atop said first additional tower section.

5. The tension-restrained articulated platform tower of claim 4 wherein each of said at least two additional tower sections is directly secured to said base tower section by a separate set of tension elements.

6. The tension-restrained articulated platform tower of claim 4 wherein said first additional tower section has a length L1 and the second additional tower section has a length L2 and the ratio of L2 to L1 is preferably in the range of from 0.8 to 1.2.

7. The tension-restrained articulated platform tower of claim 6 wherein said ratio L2/L1 is most preferably about equal to 1.

8. The tension-restrained articulated platform tower of claim 1 wherein said articulated mounting means for mounting said at least one additional tower section atop said base tower section comprises resilient joint means.

9. The tension-restrained articulated platform tower of claim 8 wherein said resilient joint means comprises an elastomeric material laminated with metallic reinforcing elements, said resilient joint means being affixed to one of said pivotally articulated tower sections and being separable from said other pivotally articulated section during compliant motion of said tower.

10. The tension-restrained articulated platform tower of claim 8 wherein said means for mounting said at least one additional tower section atop said base tower section further comprises at least one corner support post in each of the corners of said platform tower.

11. The tension-restrained articulated platform tower of claim 10 wherein said at least one corner support post comprises at least two corner support posts in each of the corners of said platform tower and each of said at least two corner support posts is equipped with said resilient joint means.

12. The tension-restrained articulated platform tower of claim 10 wherein said plurality of tension elements comprise a plurality of tendons secured to each corner support post of said platform tower.

13. The tension-restrained articulated platform tower of claim 12 wherein said plurality of tendons are mounted internally of each corner support post.

14. The tension-restrained articulated platform tower of claim 12 wherein said plurality of tendons are mounted externally of each corner support post.

15. The tension-restrained articulated platform tower of claim 1 further comprising a virtual mass generator secured to said at least one additional tower section to alter a natural flexural period of said tower to extend it beyond 20 seconds.

16. The tension-restrained articulated platform tower of claim 15 wherein said virtual mass generator comprises closed storage tanks for fluid storage.

17. An articulated connection for a tension-restrained articulated platform for interconnecting a first tower section and a second tower section sitting atop said first tower section in a first at rest position, said articulated connection comprising (a) tendon means extending between and being attached to a plurality of mating leg members of each of said first and second tower sections;

(b) resilient joint means comprised of elastomeric material with interspersed metallic reinforcing plate elements, said joint means being interconnected to one of each of said mating leg members of said first and second tower sections and being separable from the other of said leg members;

whereby said articulated connection permits compliant motion of said second tower section with respect to said first tower section in response to forces including wind, current and waves and said tendon means provides restorative forces to return said second tower section to said rest position following abatement of the forces which caused said compliant motion.

18. The articulated connection of claim 17 wherein said tendon means are connected to said mating leg members internally of said legs and wherein said resilient joint means has a centrally located aperture to receive said tendon means.

19. The articulated connection of claim 17 wherein said tension-restrained articulated platform has a plurality of corner leg members, said corner leg members having redundant resilient joint means to provide an operative backup for each corner leg member in the event of failure of a resilient joint means at a corner leg member.

* * * * *